US005816775A

United States Patent [19]

Imai et al.

[11] Patent Number: 5,816,775

[45] Date of Patent: Oct. 6, 1998

[54] DRAINAGE PUMP WITH INTERPOSED DISK

[75] Inventors: Masayuki Imai, Yokohama; Takashi Endo, Tokyo; Tatsushi Ninomiya, Yokohama, all of Japan

[73] Assignee: Fujikoki Mfg. Co., Ltd., Tokyo, Japan

[21] Appl. No.: 786,298

[22] Filed: Jan. 22, 1997

Related U.S. Application Data

[62] Division of Ser. No. 446,074, May 19, 1995, Pat. No. 5,628,618.

[30] Foreign Application Priority Data

Nov. 25, 1994 [JP] Japan ..... 6-15477
Feb. 6, 1995 [JP] Japan ..... 7-17922

[51] Int. Cl.[6] ..... F04D 17/14

[52] U.S. Cl. ..... 415/143; 415/198.1; 416/223 R

[58] Field of Search ..... 415/143, 198.1, 415/206, 218.1, 88; 416/223 R, 194

[56] References Cited

U.S. PATENT DOCUMENTS

| | | | |
|---|---|---|---|
| 2,361,750 | 10/1944 | Dinsmore et al. | 415/198.1 |
| 3,290,021 | 12/1966 | Blachly et al. | 415/88 |
| 3,746,465 | 7/1973 | Van Doorn et al. | 415/206 |
| 3,758,236 | 9/1973 | Zimmerman | 417/360 |
| 4,826,398 | 5/1989 | Gullichsen | 416/181 |
| 4,890,980 | 1/1990 | Heald et al. | 416/181 |
| 4,940,385 | 7/1990 | Gurth | 415/206 |
| 4,973,231 | 11/1990 | Colliver | 417/369 |
| 5,044,887 | 9/1991 | Duthie et al. | 416/223 B |
| 5,045,246 | 9/1991 | Dorr | 415/143 |
| 5,078,573 | 1/1992 | Peroaho et al. | 415/143 |
| 5,114,310 | 5/1992 | Haavik et al. | 415/143 |
| 5,209,641 | 5/1993 | Hoglund et al. | 416/223 B |
| 5,522,989 | 6/1996 | Hove | 210/219 |
| 5,605,439 | 2/1997 | Endoh et al. | 415/199.4 |

*Primary Examiner*—John T. Kwon
*Attorney, Agent, or Firm*—Foley & Lardner

[57] ABSTRACT

A pump body 10 of a drainage pump 1A comprises a pump chamber 12, inlet 15, and outlet 17. A rotary vane 300 mounted in the pump body 10 is coupled to a motor mounted above the pump body 10, and comprises a shaft 310 and four large-radial blades 320. Formed below the large-radial blades 320 are small-radial blades 350 to make a liquid at the inlet rise. Lower edges of the large-radial blades 320 are connected together by a disk 350 having an opening at the center and interceptively dividing the surface of the liquid rising from the inlet. Thus the amount of the liquid in contact with the large-radial blades 320 above the disk 350 decreases, and the load to the rotary vane decreases. At the same time, bubbles, noise and vibrations caused by bubbles also decrease. By surrounding the outer circumference of the large-radial blades 320 with a ring member, return water W5 moving back from the outlet 17 when the pump stops is damped by the wall member 360 and returns smoothly to the inlet 15.

25 Claims, 16 Drawing Sheets

FIG. 7(A)
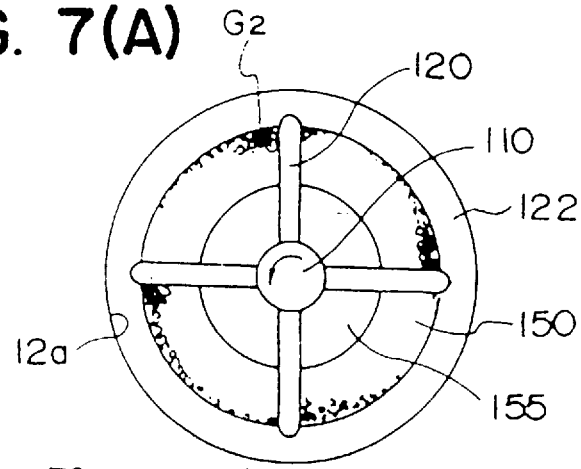
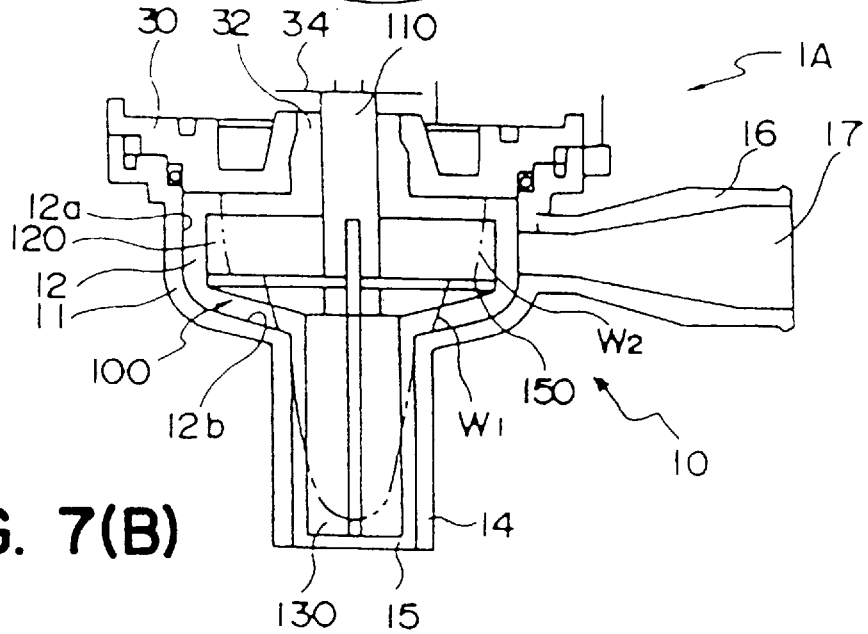
FIG. 7(B)

FIG. 19(A)
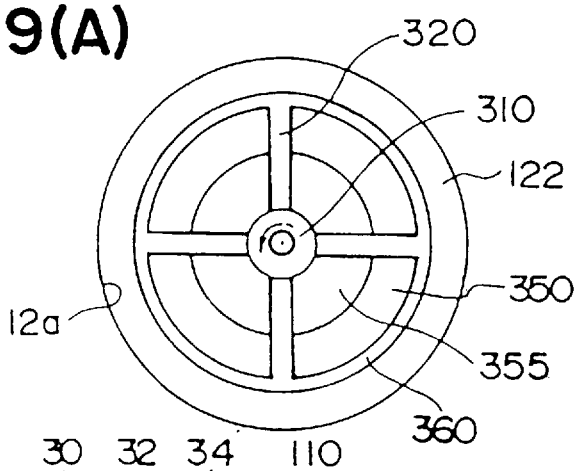
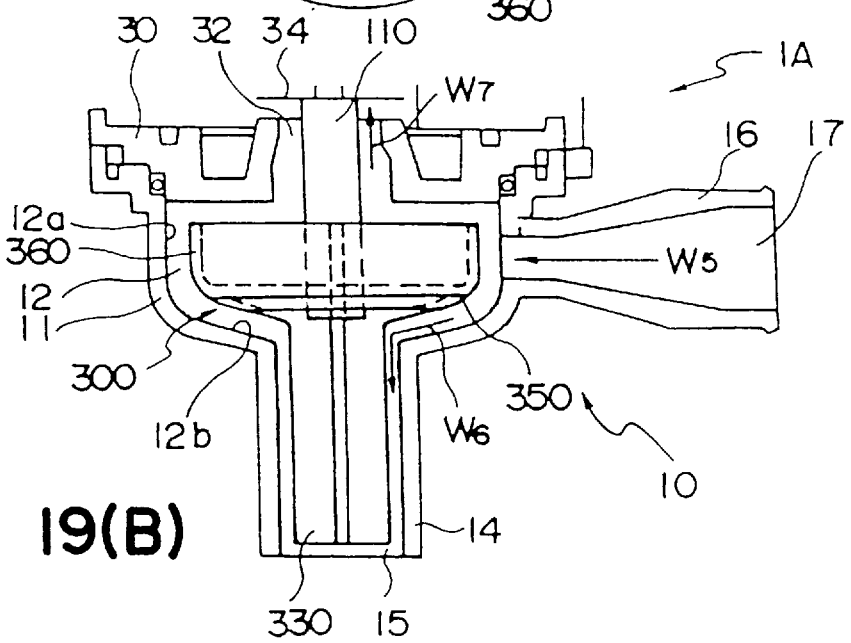
FIG. 19(B)

FIG. 41(A)
PRIOR ART
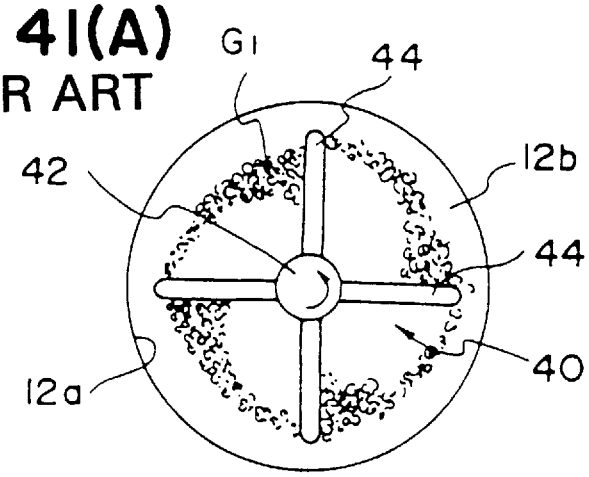
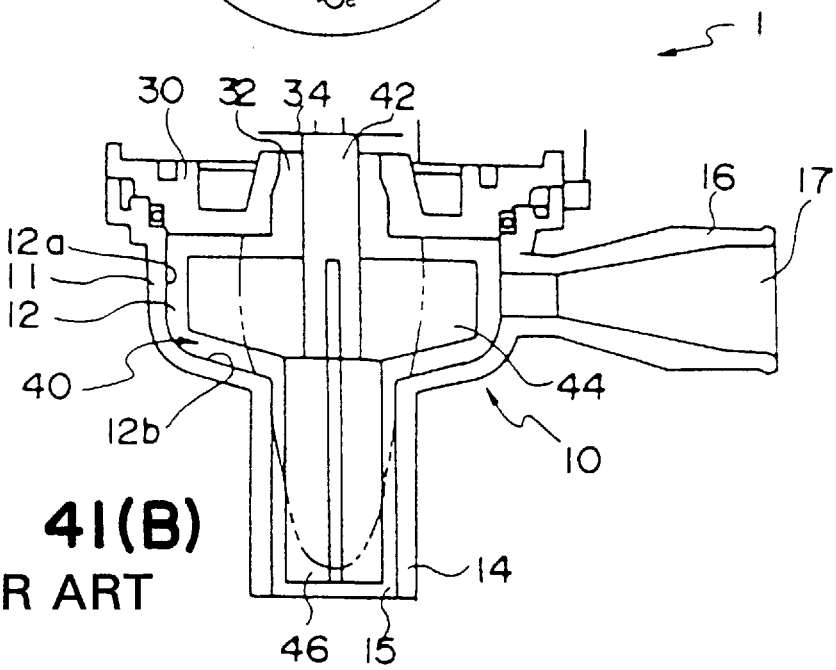
FIG. 41(B)
PRIOR ART

DRAINAGE PUMP WITH INTERPOSED DISK

This application is a divisional application of U.S. patent application Ser. No. 08/446,074 filed on May 19, 1995 now U.S. Pat. No. 5,678,618.

BACKGROUND OF THE INVENTION

1. Field of the Invention

This invention relates to a drainage pump, in particular, to be coupled to a sump tank receiving drain water in an air conditioner to discharge it to the exterior.

2. Description of the Prior Art

There are known drainage pumps for use with a sump tank of an air conditioner, such as those disclosed in Japanese Utility Model Post-Examination Publication Hei 3-35915 and Japanese Utility Model Laid-Open Publication Hei 6-60795.

Such a drain pump comprises a pump body which defines an interior chamber with a curved inside surface configured to gradually increase in inner diameter and has an inlet at a location with a smaller diameter and an outlet at a location with a larger diameter: and a rotary vane which can rotate in the pump body while keeping a distance from the inside surface of the pump body.

When the liquid reaches a level touching an end of the rotary vane, an electric motor is activated to rotate the rotary vane in a given direction. Since the outer diameter of the rotary vane and the inner diameter of the pump body progressively increase upwardly, larger and larger centrifugal force acts on the liquid as the liquid moves upwardly in the pump body. Thus a predetermined lift is maintained.

The prior art disclosed in Publication 6-60795, referred to above, uses a rotary vane with four or six blades radially extending from the rotational axle of the pump. Every other one of the blades has a shape corresponding to the upper half of its adjacent blade.

Japanese Utility Model Laid-Open Publication Hei 5-38385 discloses a drainage pump using a vane with curved small-radial blades under four rotary blades.

Similarly, Japanese Utility Model Laid-Open Publication Hei 6-67887 discloses a drainage pump using a vane with two or four small-radial blades under two or four large-radial blades.

FIGS. 41A and 41B show an arrangement of drainage pump using four large-radial blades and four small-radial blades, for example.

The drainage pump 1 comprises a pump body 10 topped with a cover 30. The pump body 10 has a pump chamber 12 defined by a cylindrical housing 11, an inlet conduit 14 forming an inlet 15 at the bottom center of the pump chamber 12, and an outlet conduit 16 horizontally extending from the pump chamber 12 and forming an outlet 17.

A rotary vane 40 mounted on the output shaft of a motor (not shown) comprises a shaft 42, four large-radial blades 44 accommodated in the pump chamber 12 connected to the shaft 42, and four small-radial blades 46 disposed under the large-radial blades 44 and accommodated in the inlet conduit 14. Provided between the shaft 42 of the vane 40 and the cover 30 is a through hole 32 covered at its upper end by a sheet 34 attached to the rotary shaft to prevent splashes of water to the exterior.

FIG. 41A is a top view of the vane 40 rotating in the pump chamber 12*b* in the arrow-marked direction during drainage of water.

For the experimental purpose, the pump body and the cover were made of a transparent resin, and a process of drainage by the rotary vane 40 was observed. FIG. 41A shows a result of the observation which reveals that bubbles labelled $G_1$ generate around the large-radial blades 44 of the rotary vane 40.

These bubbles hit the blades, inside wall surface of the pump chamber, inside wall surface of the inlet conduit, and so forth, and such collisions make a noise, vibrations, etc.

OBJECT OF THE INVENTION

It is therefore an object of the invention to provide a drainage pump having a rotary vane which decreases generation of bubbles.

SUMMARY OF THE INVENTION

A drainage pump according to the invention basically comprises: a pump body having an inlet at a lower end and an outlet at an upper lateral portion; a rotary member supported for rotation in the pump body; and a motor for rotating the rotary member. The rotary member comprises a shaft portion connected to an output shaft of the motor; plate-shaped large-radial blades extending radially from the shaft portion; small-radial blades disposed under the large-radial blades to extend in parallel with the output shaft; and a disk member having a central opening and interposed between the large-radial blades and the small-radial blades to intercept a part of the fluid running from the inlet to the outlet to restrict the flow.

The disk member having the central opening may be flat, or may have a slanted surface in accordance with the curve of the bottom surface of the pump chamber.

Outer circumferential edges of the large-radial blades are connected to each other by a wall member.

Due to the disk member having the central opening and interposed between the large-radial blades and the small-radial blades, the amount of water in contact with the large-radial blades decreases, the load applied to the rotary member is alleviated, and generation of bubbles decreases.

Further, since the outer circumferential portions of the large-radial blades are fenced by the cylindrical wall member, water moving back from the outlet side to the inlet side when the drainage pump stops is damped by the wall member and is made to drop smoothly toward the inlet. Therefore, dashing motion of water to upper portions of the pump housing is prevented, and the noise is reduced.

BRIEF DESCRIPTION OF THE DRAWING

FIGS. 7A and 7B are views showing operations of the drainage pump according to the invention;

FIGS. 19A and 19B are views showing operations of the drainage pump according to the invention;

FIGS. 41A and 41B are views showing operations of a prior art drainage pump.

DETAILED DESCRIPTION OF THE PREFERRED EMBODIMENTS

Figure 1:
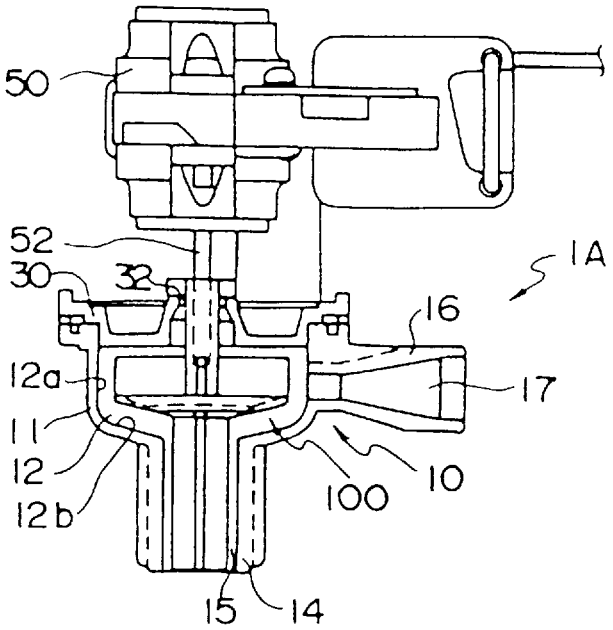
FIG. 1 is a general aspect of a drainage pump according to the invention.
Figure 2:
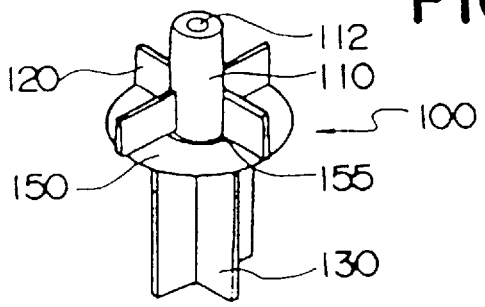
FIG. 2 is a perspective view of a rotary vane used in drainage pump according to the invention.
Figure 3:
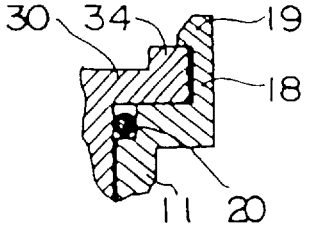
FIG. 3 is a fragmentary view showing engagement between a pump body and a cover used in the drainage pump according to the invention.

FIG. 1 is a view showing a general construction of a drainage pump taken as an embodiment of the invention. FIG. 2 is a perspective view of a rotary vane, and FIG. 3 is a fragmentary cross-sectional view showing the joint between a pump housing and a cover.

The drainage pump, generally shown at 1A, comprises a pump body 10 and a cover 30 covering the upper end of the pump body 10. The pump body 10 has a bottom surface 12*b* arcuated to gradually increase its diameter upwardly. The pump body 10 also has a pump chamber 12 defined by a cylindrical housing 11 with a wall 12*a* upstanding from the bottom surface 12*b*, an inlet conduit 14 extending from the center of the bottom surface 12*b* and forming an inlet 14, and an outlet conduit 16 extending horizontally from the pump chamber 12 and forming an outlet 17.

A motor 50 mounted on the cover 30 has an output shaft 52 connected to a shaft portion 110 of a rotary vane 100, and a predetermined distance is provided between the shaft portion 110 and the cover 30.

As shown in FIG. 2, the rotary vane 100 comprises the shaft portion 110 having a hole 112 through which the output shaft 52 of the motor 50 passes through, plate-shaped large-radial blades 120 radially extending from the shaft portion 110, an annular disk 150 attached to the large-radial blades 12O to intercept a part of the flow of a fluid running from the inlet side toward the outlet side, and plate-shaped small-radial blades 130 located under the large-radial blades 120 via the disk 150 to extend in parallel with the output shaft 52. That is, the large-radial blades 120 and the small radial blades 130 are coupled via the disk 150 which connects the outer circumferential edges of the large-radial blades 120 nearer to the small-radial blades 130.

The rotary vane 100 is mounted in the pump body 10 to place its large-radial blades 120 In the pump chamber 12 and the small-radial blades 130 in the inlet conduit 14. When the rotary vane 100 is rotated in a direction by the motor 50, a liquid pumped up through the inlet 15 by the small-radial blades 130 move up and reach the pump chamber 12, and is discharged through the outlet 17 by the large-radial vanes 120. In this case, the surface of the liquid in upward movement is substantially divided into upper and lower parts by the existence of the disk, and a part of the flow is intercepted as if the flow is restricted, so that a part of the liquid brought into contact with the large-radial vanes is discharged.

In this example, the large-radial blades 120 and the small-radial blades 130 are in four, respectively; however, these blades may be reduced or increased to other appropriate numbers.

The large-radial blades 120 are plate-shaped, and lie on planes including the axial line of the shaft portion 110. Similarly, the small-radial blades lie on planes including the axial line of the shaft portion 110. Planes on which the large-radial blades lie and those on which the small-radial blades lie may be common, or may be different in phase.

The disk 150 attached to the large-radial blades 120 is located at its end adjacent to the small-radial blades 130, and has a central circular opening 155.

The disk 150 lies on a plane normal to the axial line of the shaft portion 110, and defines an annual plane, with its outer diameter being substantially equal to that of the large-radial blades, and the central opening in its center.

The position of the disk relative to the large-radial blades may be nearest to the small-radial blades or may be any desired level within the height of the large-radial blades.

FIG. 3 shows the joint between the housing 11 and the cover 30.

The entirety of the valve body 10 is made of a synthetic resin. The housing 11 has an upper outer circumferential wall 18 having projections 19 slightly extending inwardly. Two such projections 19 may be provided in opposite symmetric positions.

The cover 30 is also made of a synthetic resin. The cover 30 has a flange portion 34 with a larger height along its outer circumferential portion. The projections 19 made of a synthetic resin has a certain resiliency. Therefore, by forcibly inserting the cover 30 down toward the projection 19, the cover 30 is brought into engagement with the housing 11 of the valve body and is held reliably due to the resiliency of the projections 19. Numeral 20 denotes a packing for sealing.

Figure 4:
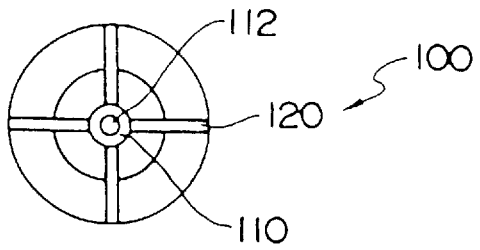
FIG. 4 is a top view of the rotary vane of FIG. 4.
Figure 5:
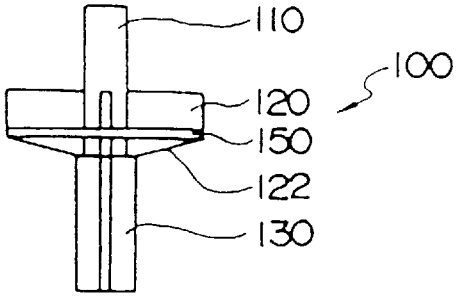
FIG. 5 is a front elevation of the same rotary vane.
Figure 6:
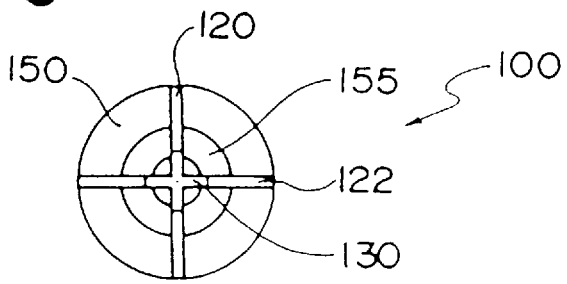
FIG. 6 is a bottom view of the same rotary vane.

FIGS. 4, 5 and 6 are top, front and bottom views of a rotary vane to be mounted in a drainage pump according to the invention.

The rotary vane, generally labelled 100, comprises the shaft portion 110 having the hole 112 through which the output shaft 52 of the motor 50 passes through, and four large-radial blades 120 comprising plate members radially extending from the shaft portion 110. Lower edges 122 of the large-radial blades 120 are slanted into a tapered shape. The rate of the taper, in this example, is in accord with the taper of the bottom surface 12*b* of the pump chamber 12 of the valve body 10. The taper of the large-radial blades need not always coincide with the taper of the bottom surface 12*b*.

Lower portions of these four large-radial blades are connected by the disk 150. The disk 150 is a flat ring having a central opening 155 defined by its inner circumferential edge.

Formed under the large-radial blades 120 are four small-radial blades 130 which are made of plate members, too. The small-radial blades 130 may be either identical or different in phase, relative to the large-radial blades 120

The outer diameter of the small-radial blades is larger than the diameter of the central opening 155 of the disk 150. Therefore, a liquid is stirred up by the small-radial blades 130 and sent toward the large-radial blades 120. The rotary vane may be made of a synthetic resin as a unitary member including the large-radial blades, disk and small-radial blades altogether, or may be an assembly of some separate parts.

FIGS. 7A and 7B are views for explaining operations of the drainage pump according to the invention.

With the drainage pump 1A equipped with the rotary vane 100, when activated, the amount of bubbles $G_2$ formed around the large-radial blades 120 is small as shown in FIG. 7A.

This relies on the existence of the disk 150 making a status in which a surface of a mixture containing liquid particles and vapor particles is divided, namely, intercepting a part of the flow as if restricting the flow, which leads to dividing the surface of the fluid into a boundary surface $W_1$, below the disk 150 and a boundary surface $W_2$ above the disk 150, such that the upper boundary surface $W_2$ is expanded radially outwardly by a centrifugal force.

As a result, the area of the liquid in contact with the large-radial blades 120 decreases. Thus the load is alleviated, and the load torque is alleviated, too, below 40 gr-cm, for example.

Due to a decrease in area of contact of the liquid with the large-radial blades 120, collisions of bubbles against the blades become less, and noisy vibrations are reduced, with a noise below 40 dB, for example.

Figure 8:
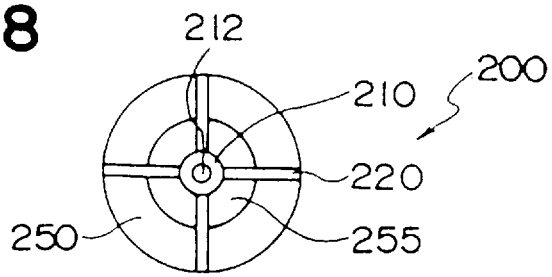
FIG. 8 is a top view of a further embodiment of rotary vane used in the drainage pump according to the invention.
Figure 9:
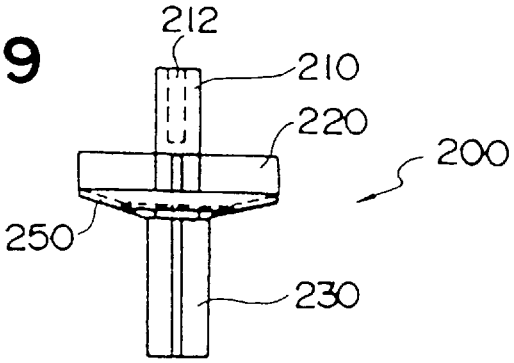
FIG. 9 is a front elevation of the rotary vane of FIG. 8.
Figure 10:
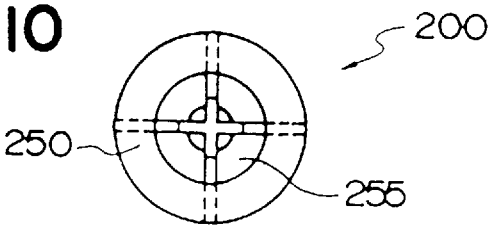
FIG. 10 is a bottom view of the rotary vane of FIGS. 8 and 9.

FIGS. 8, 9 and 10 are top, front and bottom views of a further embodiment of rotary vane used in a drainage pump according to the invention. The rotary vane here uses a dish-like disk defining a central opening along its inner circumferential portion and having a tapered surface.

That is, the rotary vane, generally shown at 200, comprises a shaft portion 210 having a hole 212 permitting a motor shaft to pass through, and four large-radial blades 220 formed around the shaft portion 210. Lower edges of the large-radial blades are shaped into a taper, and the dish-like disk 250 shaped to receive the lower edges is disposed.

Formed below the large-radial blades 220 are small-radial blades 230. These small-radial blades have the same configuration as those the former embodiment has.

Figure 11:
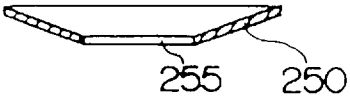
FIG. 11 is a cross-sectional view of a disk member.

FIG. 11 is an enlarged cross-sectional view of the dish-like disk 250. Also this disk has a central opening 255. The central opening 255 has an inner diameter larger than the outer diameter of the small-radial blades 230.

The drainage pump equipped with the rotary vane according to the present embodiment attains the same operations and effects as those of the former embodiment.

With the rotary vane in the present embodiment, having the tapered surface, when the vane stops, the drain is smoothly sent back to the sump tank and does not remain on the disk 250.

Figure 12:
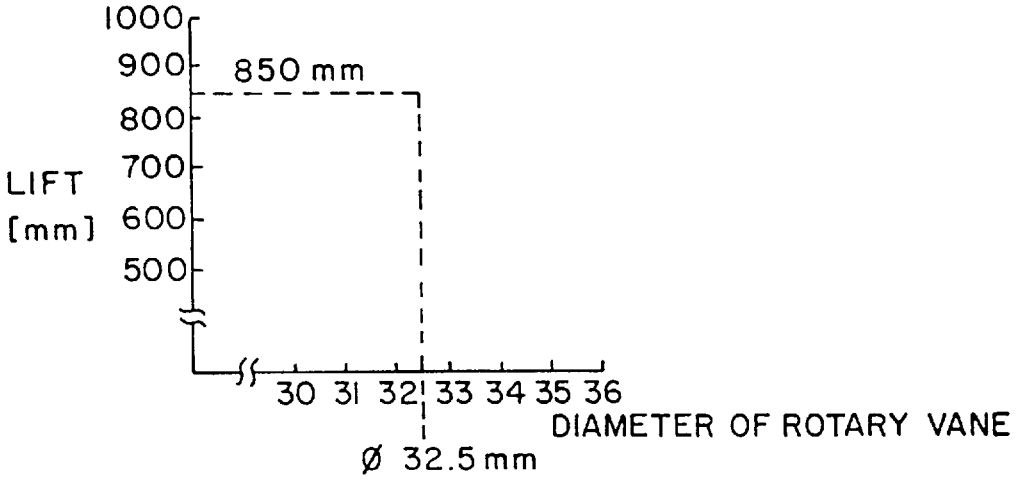
FIG. 12 is a graph showing relationships between the diameter of the rotary vane and the lift.

FIG. 12 is a graph explaining a process of determining the outer diameter of the rotary vane.

This graph allocates the radial length of the rotary vane on the horizontal axis and the maximum lift of the pump on the vertical axis.

The theoretical lift of the pump, II, is calculated from the equation shown in FIG. 12. The resulting value is shown by a solid curve in the graph. When the drainage pump is to be used in an air conditioner, it is sufficient to have the function of discharging condensed water from a heat exchanger to the exterior of the pump, and does not need a large lift.

It is therefore known that, if the rotary vane is designed to have the lift of 850 mm, for example, then the diameter of the rotary vane becomes 32.5 mm. Taking the range of the lift of the drainage pump into consideration, desirable diameter of the rotary vane is apparently 30 to 35 mm, for example.

Figure 13:
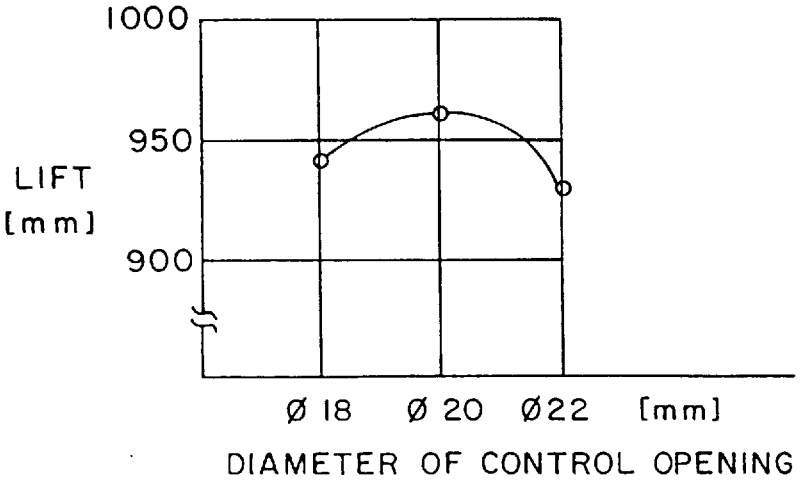
FIG. 13 is a graph showing relationships between the diameter of a central opening of the disk member and the lift.

FIG. 13 is a graph showing changes in lift with diameter of the central opening, allocating the diameter of the central opening 155 or 255 of the disk 150 or 250 on the horizontal axis and the lift on the vertical axis.

It is known from this graph that the diameter of the central opening is most preferably 20 mm, and preferably in the range of 18 to 22 mm.

Figure 14:
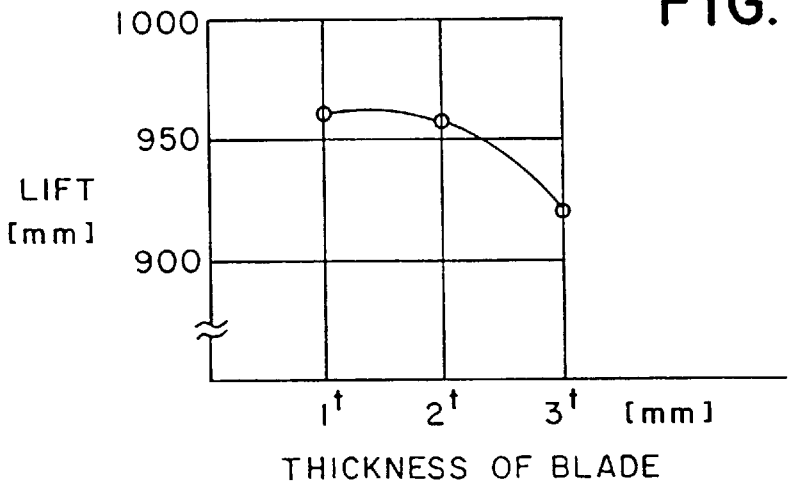
FIG. 14 is a graph showing relationships between the thickness of the disk member and the lift.

FIG. 14 is a graph showing changes in lift with thickness of the disk, allocating the thickness of the disk 150 or 250 on the horizontal axis and the lift on the vertical axis. It is known from this graph that the thickness of the disk is preferably 1 to 2 mm. Note, however, nature of the material of the disk, required mechanical strength, or the like, should be accounted for upon determining the thickness of the disk.

Figure 15A:
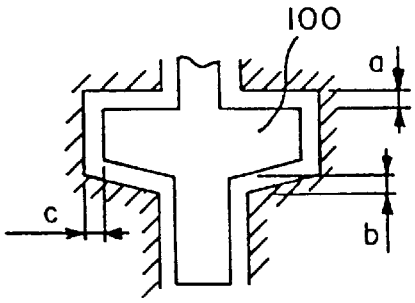
FIG. 15 is a graph showing relationships between the lift and the gap between the rotary vane and the pump body.
Figure 15B:
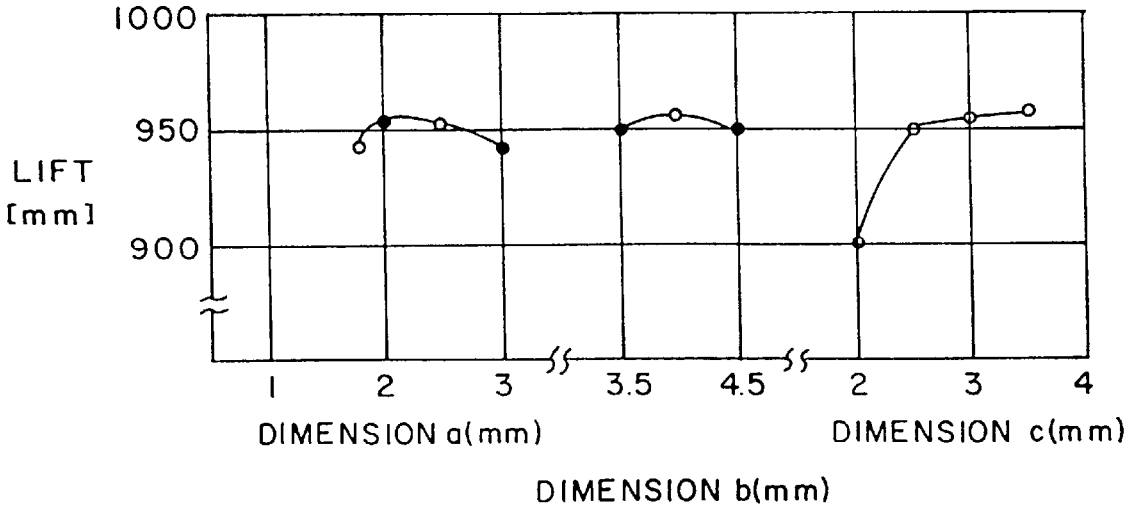

FIGS. 15A and 15B are a schematic diagram and a graph showing the size of clearance between the rotary vane and the pump housing. The graph allocates changes in such clearance on the horizontal axis and changes in lift on the vertical axis. Changes in clearance acts on the lift as indicated in the graph. Thus the clearance between the rotary vane and the pump housing may be determined on the basis of these graphs.

Figure 16:
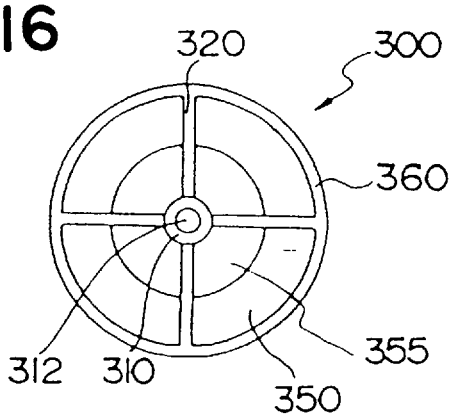
FIG. 16 is a top view showing a further embodiment of rotary vane used in the drainage pump according to the invention.
Figure 17:
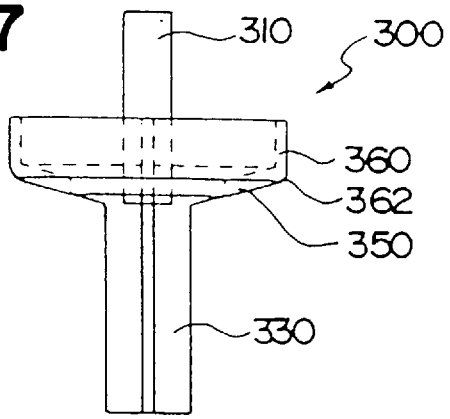
FIG. 17 is a front elevation of the rotary vane of FIG. 16.
Figure 18:
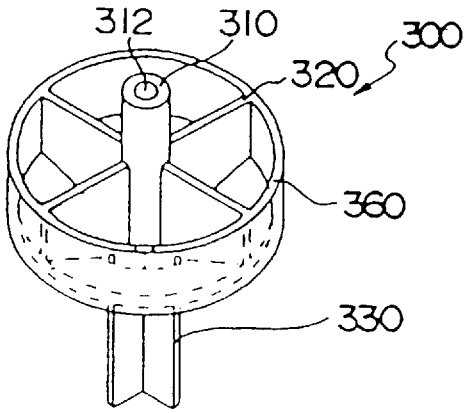
FIG. 18 is a perspective of the rotary vane of FIGS. 16 and 17.

FIGS. 16, 17 and 18 are top, front and perspective views of a further embodiment of the rotary vane according to the embodiment.

The rotary vane, generally labelled 300, comprises a shaft portion 310 having a hole 312 permitting a motor shaft to pass through, and large-radial blades 320, for example, in four, formed around the shaft portion 310. Lower edges of the large-radial blades are shaped into a taper. These lower edges are connected together by a disk 350 having a central opening 355 and shaped into a corona-headed, conical dish.

Outer circumferential edges of the large-radial blades 320 are connected together by a cylindrical wall member 360. The wall member 360 defines a cylindrical outer circumferential surface coaxial with the shaft 310, and has a lower end shaped into a taper or an arc 362 which is continuous to the lower surface of the dish-like disk 350.

Formed below the large-radial blades 320 are small-radial blades 330. These small-radial blades have the same configuration as those the former embodiment has.

FIGS. 19A and 19B are views for explaining operations of the drainage pump according to the embodiment of the invention. Due to the rotary vane 300 having the ring-shaped wall member 360, the inertial momentum of the entirety of the rotary vane 300 increases, and the rotational balance is improved.

Further, when the drainage pump stops, water W5 which returns from the outlet 17 toward the inlet 15 collides against the ring-shaped wall member 360, and is eventually distributed in the pump by the resistance of the ring-shaped wall member 360. Due to this process, generation of a noise caused by return water is reduced.

Additionally, the flow of the return water is damped by collision against the wall member, and results in a moderate flow W6 which smoothly drops toward the inlet 15. Therefore, it is prevented that the return water from the through hole 32 of the cover 30 dashes toward the motor as shown at W8.

Meanwhile, the tapered or arcuated portion 362 at the bottom of the ring-shaped wall member 360 smoothly guides the return water toward the inlet.

As a result, this embodiment prevents damages to the motor due to return water and dispersion of water to the surrounding atmosphere.

The wall member 360 may be an assembly of some separate members of a synthetic resign or may be integral formed as a unitary part of the rotary vane 300.

Figure 20:
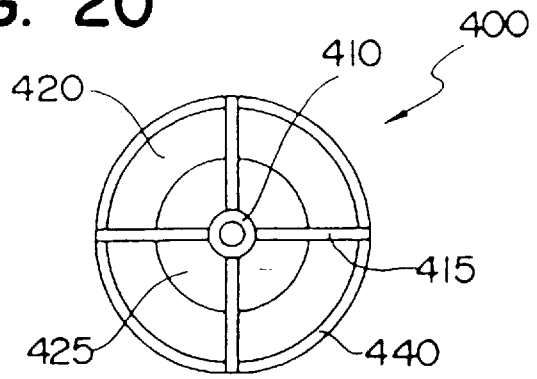
FIG. 20 is a top view showing a further embodiment of rotary vane used in the drainage pump according to the invention.
Figure 21:
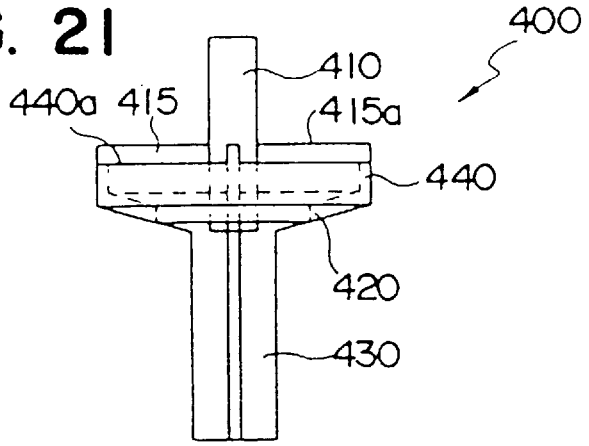
FIG. 21 is a front elevation of the rotary vane of FIG. 20.
Figure 22:
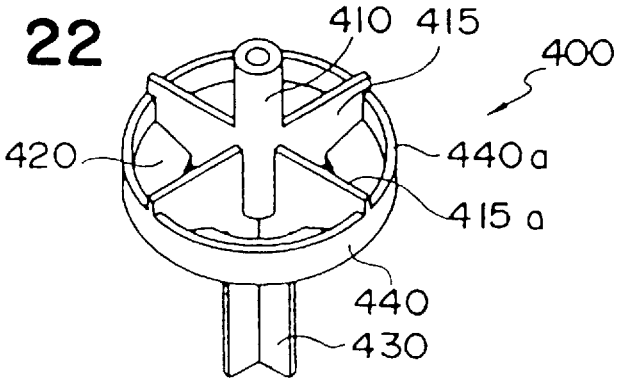
FIG. 22 is a perspective view of the rotary vane of FIGS. 20 and 21.

FIGS. 20, 21 and 22 are top, front and perspective views of a further embodiment of the rotary vane according to the embodiment.

The rotary vane, generally labelled 400, comprises a shaft portion 410, and large-radial blades 415 formed around the shaft portion 410. Lower edges of the large-radial blades are shaped into a taper and are connected together by a disk member 420 having a central opening 425. Formed below the large-radial blades 415 are small-radial blades 430.

Outer circumferential edges of the large-radial blades 415 are connected together by a ring-shaped wall member 440. Upper edges 415*a* of the large-radial blades 415 are exposed above upper edges 440*a* of the ring-shaped wall member 440. The exposed portions of the large-radial blades 415 contribute to maintaining the maximum lift of the rotary vane.

Figure 23:
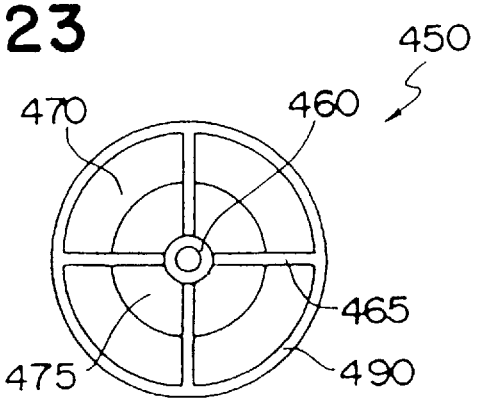
FIG. 23 is a top view of a further embodiment of rotary vane used in the drainage pump according to the invention.
Figure 24:
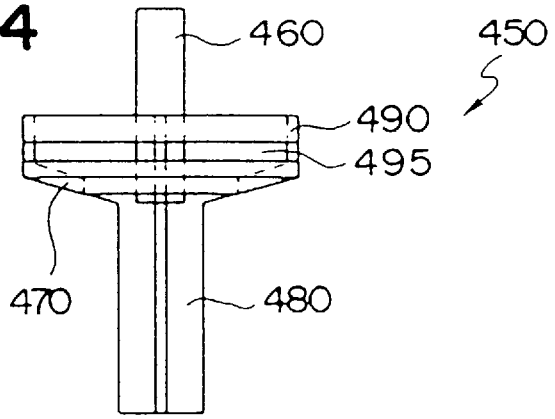
FIG. 24 is a front elevation of the rotary vane shown in FIG. 23.
Figure 25:
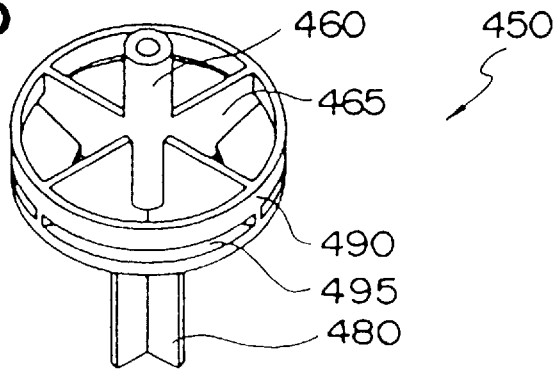
FIG. 25 is a perspective view of the rotary vane shown in FIGS. 23 and 24.

FIGS. 23, 24 and 25 are top, front and perspective views of a further embodiment of rotary vane according to the invention.

The rotary vane, 450, comprises a shaft portion 460, and large-radial blades 465 around the shaft portion 460. Lower edges of the large-radial blades 465 are shaped into a taper, and are connected together by a disk member 470 having a central opening 475. Formed below the large-radial blades 465 are small-radial-blades 480.

Outer circumferential edges of the large-radial blades 465 are connected together by a ring-shaped wall member 490. The wall member 490 have rectangular windows 495 at intermediate locations. The large-radial blades 465 exposed through the rectangular windows 495 contribute to ensuring the maximum lift of the rotary vane.

Figure 26:
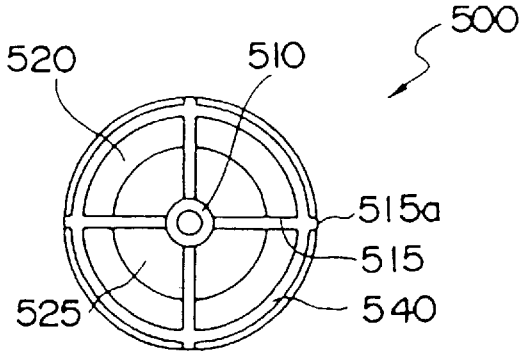
FIG. 26 is a top view of a further embodiment of rotary vane used in the drainage pump according to the invention.
Figure 27:
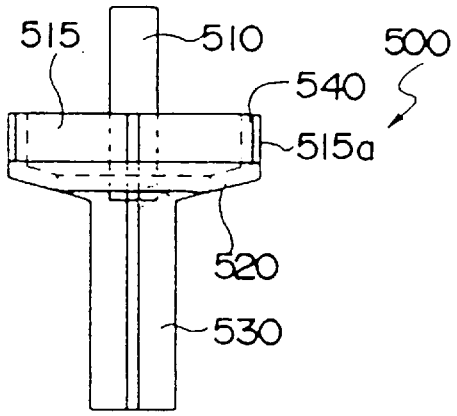
FIG. 27 is a front elevation of the rotary vane shown in FIG. 26.
Figure 28:
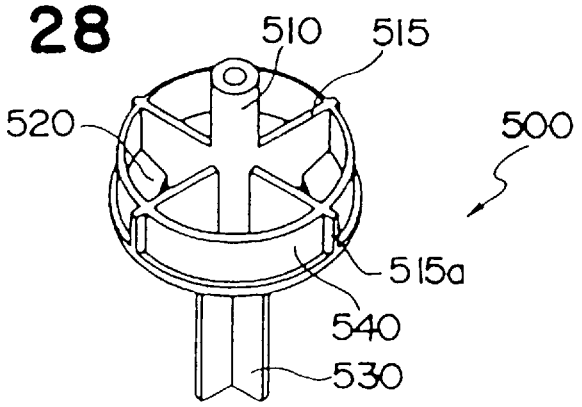
FIG. 28 is a perspective view of the rotary vane shown in FIGS. 26 and 27.

FIGS. 26, 27 and 28 are top, front and perspective views of a further embodiment of rotary vane according to the invention.

The rotary vane, 500, comprises a shaft portion 510, and large-radial blades 515 around the shaft portion 510. Lower edges of the large-radial blades 515 are shaped into a taper, and are connected together by a disk member 520 having a central opening 525. Formed below the large-radial blades 515 are small-radial blades 530.

The large-radial blades 515 are connected together near their outer circumferential edges 515*a* by a ring-shaped wall member 540 such that the outer circumferential edges 515*a* of the large-radial blades 515 project outwardly from the wall member 540. The projecting portions 515*a* of the large-radial blades 515 contribute to enhancement of the maximum lift of the rotary vane.

An appropriate amount of projection of the projecting portions 515*a* is within 5 mm, for example.

Figure 29:
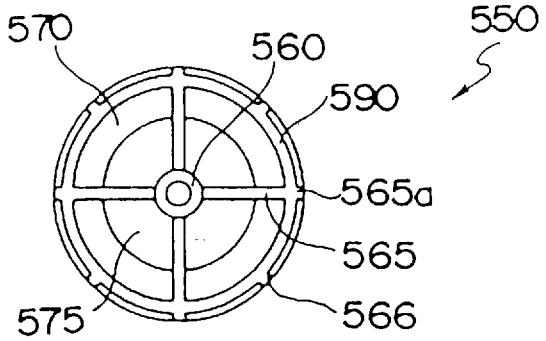
FIG. 29 is a top view of a further embodiment of rotary vane used in the drainage pump according to the invention.
Figure 30:
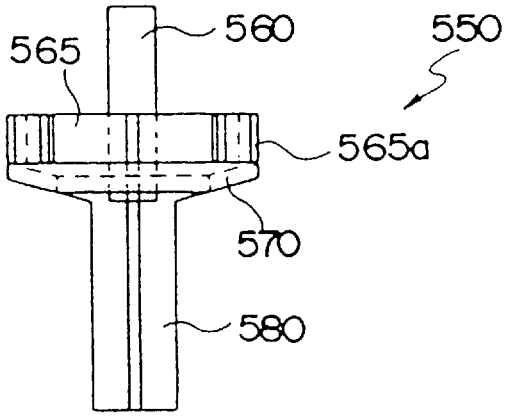
FIG. 30 is a front elevation of the rotary vane shown in FIG. 29.
Figure 31:
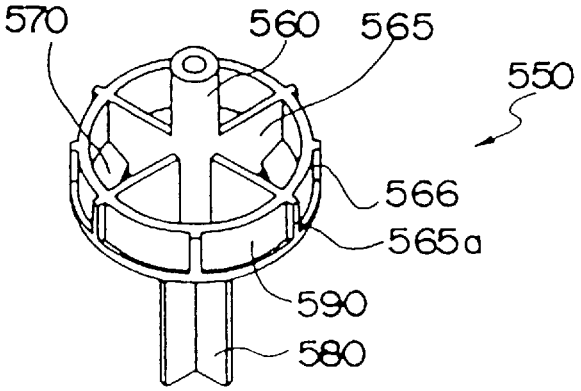
FIG. 31 is a perspective view of the rotary vane shown in FIGS. 29 and 30.

FIGS. 29, 30 and 31 are top, front and perspective views of a further embodiment of rotary vane according to the invention.

The rotary vane, 550, comprises a shaft portion 560, and large-radial blades 565 around the shaft portion 560. Lower edges of the large-radial blades 565 are shaped into a taper, and are connected together by a disk member 570 having a central opening 575. Formed below the large-radial blades are small-radial blades 580.

The large-radial blades 565 are connected together near their outer circumferential edges 565*a* by a ring-shaped wall member 590 such that the outer circumferential edges 565*a* of the large-radial blades 565 project outwardly of the wall member 590.

Additional projections 566 similar to the projections 565*a* are provided at equal intervals. These projections contribute to ensuring the maximum lift of the rotary vane.

Figure 32:
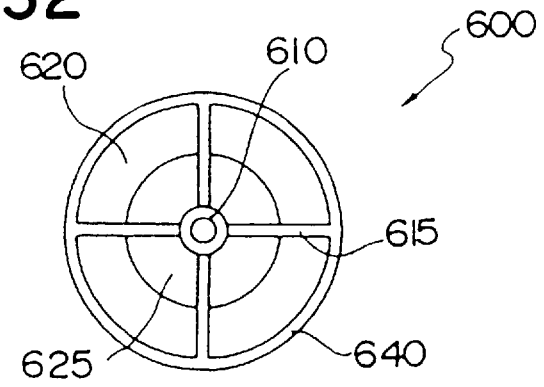
FIG. 32 is a top view of a further embodiment of rotary vane used in a drainage pump according to the invention.
Figure 33:
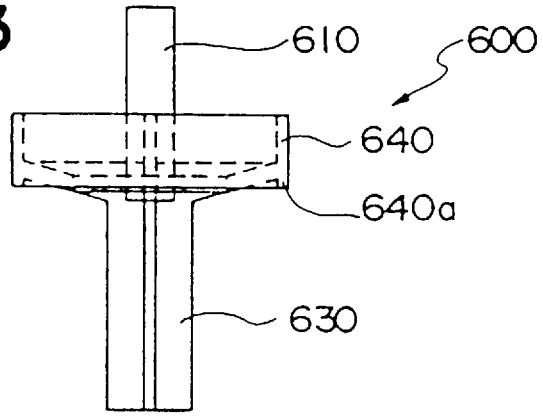
FIG. 33 is a front elevation of the rotary vane shown in FIG. 32.
Figure 34:
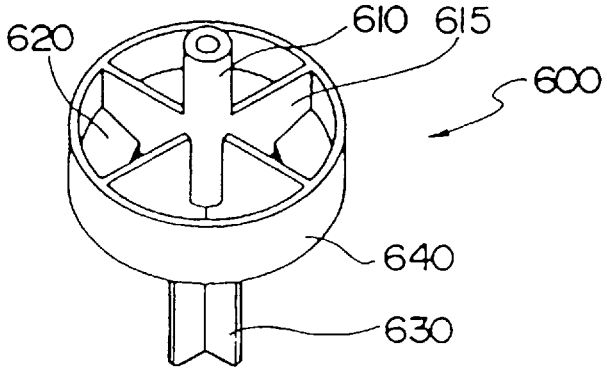
FIG. 34 is a perspective view of the rotary vane shown in FIGS. 32 and 33.

FIGS. 32, 33 and 34 are top, front and perspective views of a further embodiment of rotary vane according to the invention.

The rotary vane, 600, comprises a shaft portion 610 and large-radial blades 615 around the shaft portion 610. Lower edges of the large-radial blades 615 are shaped into a taper and are connected together by a disk member 620 having a central opening 625. Formed below the large-radial blades 615 are small-radial blades 630.

Outer circumferential edges of the large-radial blades 615 are connected together by a ring-shaped wall member 640 which is long enough to have lower portions 640*a* projecting downward of the disk member 615.

The downward projections increases the effect of intercepting water, restricting the flow amount and reducing the load.

Figure 35:
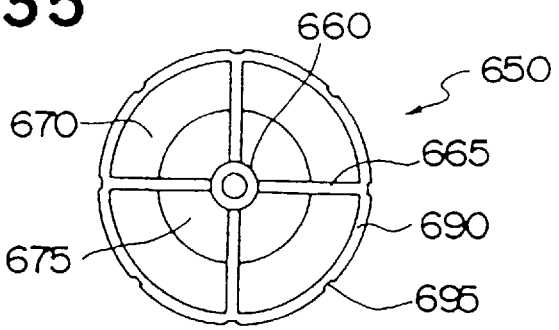
FIG. 35 is a top view of a further embodiment of rotary vane used in a drainage pump according to the invention.
Figure 36:
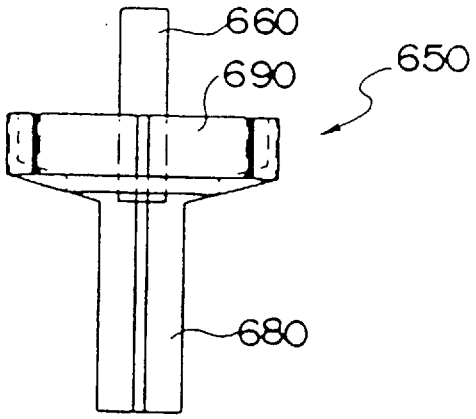
FIG. 36 is a front elevation of the rotary vane shown in FIG. 35.
Figure 37:
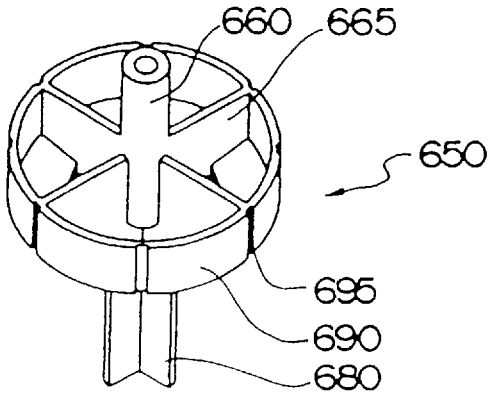
FIG. 37 is a perspective view of the rotary vane shown in FIGS. 35 and 36.

FIGS. 35, 36 and 37 are top, front and perspective views of a further embodiment of rotary vane according to the invention.

The rotary vane, 650, comprises a shaft portion 660, and large-radial blades 665 around the shaft portion 660. Lower edges of the large-radial blades 665 are shaped into a taper, and are connected together by a disk member 670 having a central opening 675. Formed below the large-radial blades 665 are small-radial blades 680.

Outer circumferential edges of the large-radial blades 665 are connected together by a ring-shaped wall member 690. The wall member 690 has axial grooves 695 in its outer circumferential surface to ensure the maximum lift of the rotary vane.

Figure 38:
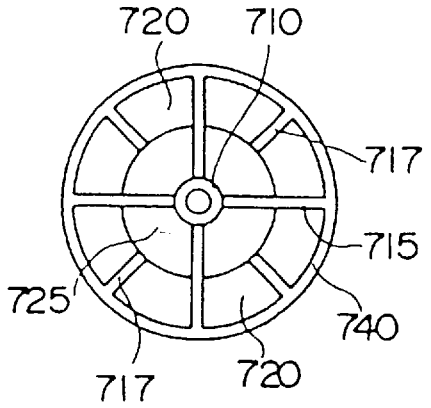
FIG. 38 is a top view or a further embodiment of rotary vane used in a drainage pump according to the invention.
Figure 39:
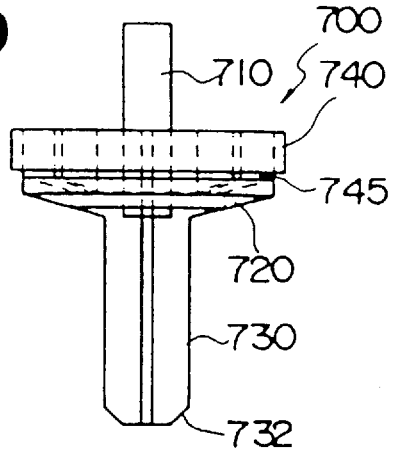
FIG. 39 is a front elevation of the rotary vane shown in FIG. 38.
Figure 40:
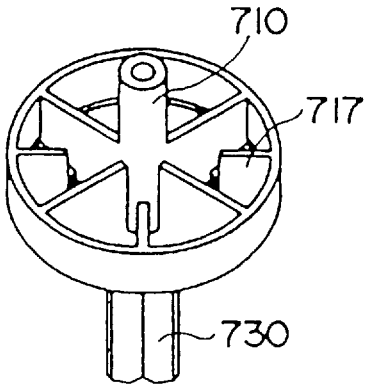
FIG. 40 is a perspective view of the rotary vane shown in FIGS. 38 and 39.

FIGS. 38, 39 and 40 are top, front and perspective views of a further embodiment of rotary vane according to the invention.

The rotary vane, 700, comprises a shaft portion 710, and large-radial blades 715 around the shaft portion 710. Lower edges of the large-radial blades 715 are shaped into a taper, and are connected together by a disk member 720 having a central opening 725. Formed below the large-radial blades 715 are small-radial blades 730.

Outer circumferential edges of the large-radial blades 715 are connected together by a ring-shaped wall member 740. Formed between the wall member 740 and the disk member 720 is an annular opening 745. The wall member 740 has blade members 717 which extend radially inwardly from the inner circumferential surface of the wall member 740 toward the center line. These blade member 717 are disposed to equally divide the distance between respective adjacent large-radial blades 715.

The annular opening 745 between the wall member 740 and the disk member 720 forms rectangular windows partitioned by the large-radial blades 715 and the blade members 717.

Formed at a position proximal to the inlet of the pump body is a tapered portion which decreases the diameter of the aperture. In accordance with the tapered portion, lower ends of the small-radial blades may be shaped into a taper 732.

In this example, since no projection extends from the outer circumferential surface of the wall member, only small amounts of bubbles are generated, and the maximum lift of the rotary vane can be increased with low noise and low vibrations.

Additionally, since water near the inlet is sucked along the taper, it gives effects such as lowering the minimum water level permitting water to be sucked.

Although the foregoing embodiments have been described as the large-radial blades having tapered lower edges, the invention is not limited to these configurations. That is, lower ends of the large-radial blades may be flat so that such flat lower edges are connected together by a disk member. Further, the wall members may be polygonal-cylinders equivalent to the circular cylinders illustrated.

The tapered configurations of the lower ends of the small-radial blades and of the inlet of the pump body may be used in the other embodiments, too.

According to the invention, the drainage pump uses a rotary vane mounted in the pump body and driven by a motor, which comprises a plurality of large-radial blades and a plurality of small-radial blades disposed under the large-radial blades. And, lower edges of the large-radial blades are connected together by a disk having a central opening.

With one or another of such arrangements, the surface of a liquid, rising from the small-radial blades rotating in the inlet toward the large-radial blades, is substantially divided into upper and lower parts by the disk, and a part of the liquid brought into contact with the large-radial blades is discharged. Due to this function, the amount of liquid acting on the large-radial blades decreases, and the load applied to the rotary vane decreases.

Additionally, the amount of bubbles generated decreases, and a noise caused by bubbles also decreases.

Further, by employing the structure surrounding outer circumference of the large-radial blades with a wall member, return water, moving back from the outlet toward the inlet when the drainage pump stops, is damped by collision against the wall member, and eventually drops smoothly down to the inlet. Therefore, the invention provides various effects such as preventing return water from jetting out from the upper end of the pump housing, reducing a noise caused by splashes of water, and so forth.

What is claimed is:

1. A drainage pump, comprising:

a pump body having an inlet at its lower end and an outlet at its upper lateral portion;

a rotary member supported for rotation in said pump body; and a motor for rotating said rotary member, said rotary member comprising a shaft portion coupled to an output shaft of said motor; large-radial blades extending radially outwardly from said shaft portion, said large-radial blades having an outer surface extending in a substantially straight line throughout their radial extent; small-radial blades extending under said large-radial blades; and a disk interposed between said large-radial blades and said small-radial blades, said disk having an opening at its center and a slanted surface.

2. A drainage pump according to claim 1, further comprising a wall member connecting radially outer portions of said large-radial blades together.

3. A drainage pump according to claim 2, wherein said wall member is a cylindrical ring member.

4. A drainage pump according to claim 3, wherein said ring member and said disc are connected by a curved surface.

5. A drainage pump according to claim 2, wherein outer circumferential edges of said large-radial blades project radially outwardly of said wall member.

6. A drainage pump according to claim 2, wherein said wall member comprises an outer circumferential surface and axial grooves formed on the outer circumferential surface.

7. A drainage pump according to claim 2, said pump further comprising a window opening formed between said wall member and said disk.

8. A drainage pump according to claim 2, wherein said wall member comprises an inner circumferential surface, said pump further comprising a blade member extending radially inwardly from said inner circumferential surface of said wall member.

9. A drainage pump according to claim 8, wherein a window opening is formed between said wall member and said disk.

10. A drainage pump according to claim 1, wherein said small-radial blades extend in an axial direction parallel to said output shaft.

11. A drainage pump according to claim 1, wherein said disk has an outer diameter substantially equal to the outer diameter defined by the large-radial blades.

12. A drainage pump according to claim 1, wherein said disk contacts said large-radial blades.

13. A drainage pump including a pump body having a pump chamber with a bottom surface defined by a curved surface gradually increasing in diameter, an inlet formed at an end of said pump chamber nearer to small-radial blades, and an outlet formed at an end portion of said pump chamber nearer to large-radial blades; a cover topping an aperture at the upper end of said pump body; a driving motor mounted above said cover; and a rotary member mounted on a driving shaft of said motor and rotated in said pump body with a gap from said pump body, wherein:

said rotary member comprises a shaft portion coupled to an output shaft of said motor, plate-shaped large-radial blades extending radially outwardly from said shaft portion, small-radial blades provided under said large-radial blades to rotate in said inlet, and a disk connecting lower edges of said large-radial blades and having an opening at the center thereof, said disk having a slanted surface.

14. A drainage pump according to claim 13, wherein the slanted surface of the disk is slanted in accordance with the bottom surface of said pump chamber.

15. A drainage pump according to claim 13, said pump further comprising a tapered portion formed to define the inner diameter of said inlet of said pump body.

16. A drainage pump according to claim 15, wherein said small-radial blades have tapered portions at their distal ends to follow said tapered portion at said inlet of said pump body.

17. A drainage pump according to claim 13, further comprising a wall member connecting radially outer portions of said large-radial blades together.

18. A drainage pump according to claim 17, wherein said wall member is a cylindrical ring member.

19. A drainage pump according to claim 18, wherein said ring member and said disc are connected by a curved surface.

20. A drainage pump according to claim 17, wherein outer circumferential edges of said large-radial blades project radially outwardly of said wall member.

21. A drainage pump according to claim 17, wherein said wall member comprises an outer circumferential surface and axial grooves formed on the outer circumferential surface.

22. A drainage pump according to claim 17, said pump further comprising a window opening formed between said wall member and said disk.

23. A drainage pump according to claim 17, wherein said wall member comprises an inner circumferential surface, said pump further comprising a blade member extending radially inwardly from said inner circumferential surface of said wall member.

24. A drainage pump according to claim 23, wherein a window opening is formed between said wall member and said disk.

25. A drainage pump according to claim 12, wherein said disk has an outer diameter substantially equal to the outer diameter defined by the large-radial blades.

* * * * *